United States Patent [19]

Medlinsky

[11] Patent Number: 4,526,139

[45] Date of Patent: Jul. 2, 1985

[54] INTERNAL COMBUSTION ENGINE

[76] Inventor: Edward I. Medlinsky, 3 Kelley Sq., Worcester, Mass. 01610

[21] Appl. No.: 530,708

[22] Filed: Sep. 9, 1983

[51] Int. Cl.[3] ..... F02B 41/00

[52] U.S. Cl. ..... 123/26

[58] Field of Search ..... 123/26, 585, 432, 316

[56] References Cited

U.S. PATENT DOCUMENTS

| | | | |
|---|---|---|---|
| 2,522,649 | 9/1950 | Tenney | 123/65 R |
| 2,939,441 | 6/1960 | Luttrell | 123/76 R |
| 3,003,483 | 10/1961 | Büchi | 123/79 C |
| 3,785,355 | 1/1974 | Toepel | 123/316 |
| 3,814,065 | 6/1974 | Gospodar | 123/26 |
| 3,880,126 | 4/1975 | Thurston et al. | 123/65 VD |
| 3,895,617 | 7/1975 | Sakurai | 123/253 |
| 3,959,974 | 6/1976 | Thomas | 123/25 R |
| 3,964,451 | 6/1976 | Goto | 123/26 |
| 3,991,721 | 11/1976 | Hurd | 123/1 R |
| 4,088,099 | 5/1978 | Gruden | 123/259 |
| 4,112,877 | 9/1978 | Goto et al. | 123/26 |
| 4,127,089 | 11/1978 | Tsutsumi | 123/255 |
| 4,159,699 | 7/1979 | McCrum | 123/1 R |
| 4,217,866 | 8/1980 | Nakajima | 123/26 |
| 4,223,645 | 9/1980 | Nohira et al. | 123/316 |

FOREIGN PATENT DOCUMENTS

WO81/00011 3/1981 PCT Int'l Appl. .

*Primary Examiner*—William A. Cuchlinski, Jr.
*Attorney, Agent, or Firm*—Blodgett & Blodgett

[57] ABSTRACT

Engine having a bore and piston in which the exhaust stroke of the piston approaches the cylinder head closely, so that very little product of combustion remains, this taking place by use of an auxiliary chamber.

1 Claim, 5 Drawing Figures

SUCTION

COMPRESSION

FIRING

EXHAUST

INTERNAL COMBUSTION ENGINE

BACKGROUND OF THE INVENTION

One of the major difficulties experienced in the design and operation of internal combustion engines is the fact that it is difficult to remove all of the products of combustion on the exhaust stroke. This is because room must be left between the piston and the surface of the head to provide for the compressed fuel-air mixture during the compression stroke. When such products of combustion remain, they mix with the next supply of fuel-air mixture (during the suction stroke) and cause poor or incomplete combustion, thus leading to pollution and as well as poor fuel economy. This situation is, of course, true whether the internal combustion engine be operated with a fuel-air mixture arriving from a carburetor or whether the air and fuel arrive by separate means as in the case of fuel injection. It is even true in those cases where the air arrives under pressure, as in the case of a supercharged engine or in the case of the rare air injection nozzle systems that have been proposed in the past. These and other difficulties experienced with the prior art devices have been obviated in a novel manner by the present invention.

It is, therefore, an outstanding object of the invention to provide an internal combustion engine in which products of combustion are almost entirely removed during the exhaust stroke.

A further object of the present invention is the provision of internal combustion engine in which the piston approaches the surface of the cylinder head very closely.

Another object of this invention is the provision of internal combustion engine in which the fuel is burned very efficiently, because flame pattern and wave front are not inhibited by the presence of unburned products of combustion.

It is another object of the instant invention to provide an internal combustion engine which has been made more efficient than present engines by a simple change in construction that does not require a complete redesign of the engine.

With these and other objects in view, as will be apparent to those skilled in the art, the invention resides in the combination of parts set forth in the specification and covered by the claims appended hereto.

SUMMARY OF THE INVENTION

In general, the present invention consists of an internal combustion engine of the 4-cycle type with a block having a bore and a with head mounted on the block with a surface which closes one end of the bore. A piston is slidable in the bore to a position close to the head, so that very little product of combustion remains at the end of the exhaust stroke. A chamber is formed in the head and has access to the upper end of the bore, while means is provided for admitting compressed air into the chamber during the compression stroke.

Most specifically, a first valve leads from the said surface of the head through a passage to a source of combustion air, a second valve leads from the surface of the head through a passage to exhaust, and the said means is a third valve leading from the said surface of the head to the chamber.

BRIEF DESCRIPTION OF THE DRAWINGS

The character of the invention, however, may be best understood by reference to one of its structural forms, as illustrated by the accompanying drawings, in which.

Figure 1:
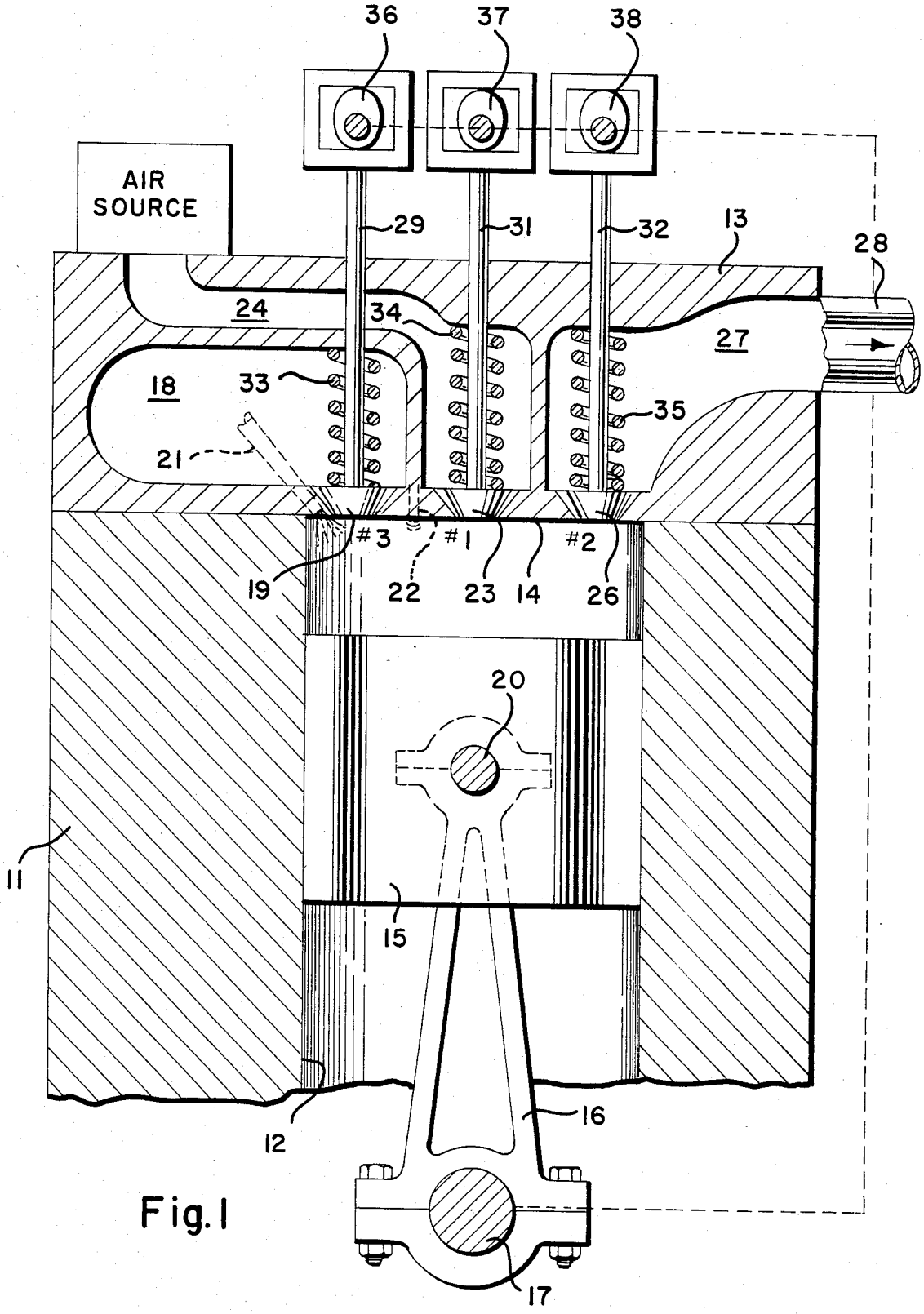
FIG. 1 is a vertical sectional view of an internal combustion engine embodying the principles of the present invention.

Referring first to FIG. 1, wherein are best shown the general features of the invention, it can be seen that the internal combustion engine, indicated generally by the reference numeral 10, is of the 4-cycle type. That is to say, each piston reciprocates twice during a firing cycle. The piston moves downwardly during the suction portion of the cycle, upwardly during the compression stage, downwardly again during firing, and then upwardly again during exhaust. The engine 10 is provided with a block 11, having a cylinder bore 12. Located on the block is a head 13, having an undersurface 14 which fits tightly against the upper surface of the block and also serves to close the end of the bore 12. A piston 15 is slidable in the bore 12 to a position at the upper end which is close to the head. In this way, there is no space for products of combustion to remain at the end of the exhaust stroke. The piston 15 is provided in the usual way with a wrist pin 20 to which is connected a connecting rod 16 which joins the piston to the crank shaft 17 in the conventional manner.

Formed in the head 13 is a chamber 18 which has access to the upper end of the bore. Means, such as a valve 19, serves to admit compressed air into the chamber 18 during the compression stroke of the engine.

The engine is provided with a fuel injection nozzle 21 and with a spark plug 22 of the conventional type, located in the head. It will be understood that the engine could be provided with fuel in the air mixture provided by a carburetor. A first valve 23 leads from the surface 14 of the head through a passage 24 to a source 25 of combustion air. As has been mentioned above, this source could also be a supercharger, providing air under pressure or it could be a carburetor in which the fuel and air are mixed together. In this last case, the engine would not be provided with the fuel injection nozzle 21. The second valve 26 leads from the surface 14 of the head through a passage 27 to exhaust which in the usual case will be an exhaust system, including mufflers, tail pipes, and the like. The valves 19, 23, and 26 are arranged in the head in such a way that they open upwardly, but are maintained in closed position by compression springs 33, 34, and 35, respectively. These springs surround stems 29, 31, and 32 of the valves 19, 23, and 26, respectively. The upper ends of the stems are engaged by cams 36, 37, and 38, respectively, which, because of a Scotch-yoke arrangement, serve to pull the stems 29, 31, and 32 up and down in the usual way to open the valves against the compression spring pressure.

The cams 36, 37, and 38 are arranged in a suitable manner to cause the valves 19, 23, and 26, respectively to be open or closed at certain parts of the cycle of piston movement. For instance, the third valve 19 is closed during the exhaust stroke and opened during the compression stroke. Because of the arrangement of the valves when they are closed, it can be seen that they do not add to the volume of the bore 12, so that, at the end of the exhaust stroke, there is very little volume between the surface of the head 13 and the piston 15.

The operation of the invention will now be readily understood in view of the above discussion. The engine, when operated, receives air from the air source 25, receives fuel through the fuel injection nozzle 21, and the mixture is ignited by the spark plug 22. Normally, the piston 15 would be only one piston of an engine having a plurality of cylinders and pistons all connected to a common crank shaft 17. Furthermore, the chamber 18 may be common to all of the piston-and-cylinder combinations. The chamber 18 may be of a variable or adjustable volume to permit changing of the compression ratio and to change the operation of the engine.

Figure 2:
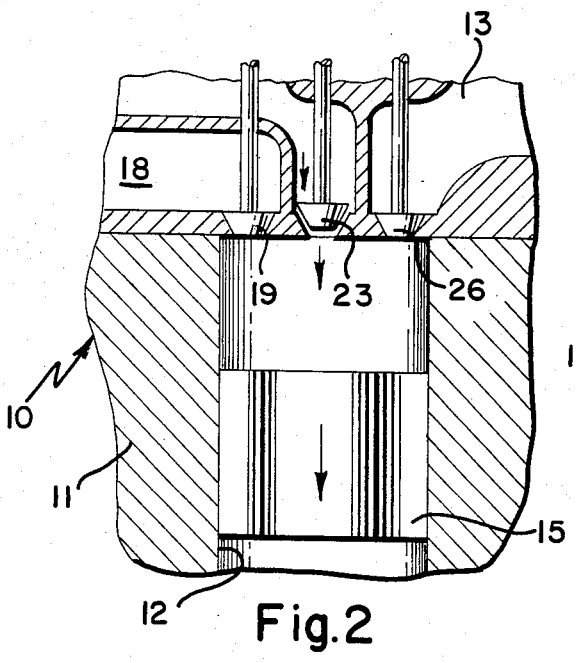
FIGS. 2, 3, 4, and 5 are schematic views of the engine taken during the suction, compression, firing, and exhaust portions of the cycle, respectively.

Referring to FIG. 2, it can be seen that during the suction stroke, the piston 15 moves downwardly in the bore 12 and the cam 36 causes the valve 19 to be closed, the cam 37 causes the valve 23 to be opened and the cam 38 causes the valve 26 to be closed. In this way, the downward movement of the piston 15 causes air to be drawn from the air source 25 through the passage 24 and into the space in the bore 12 above the piston.

Figure 3:
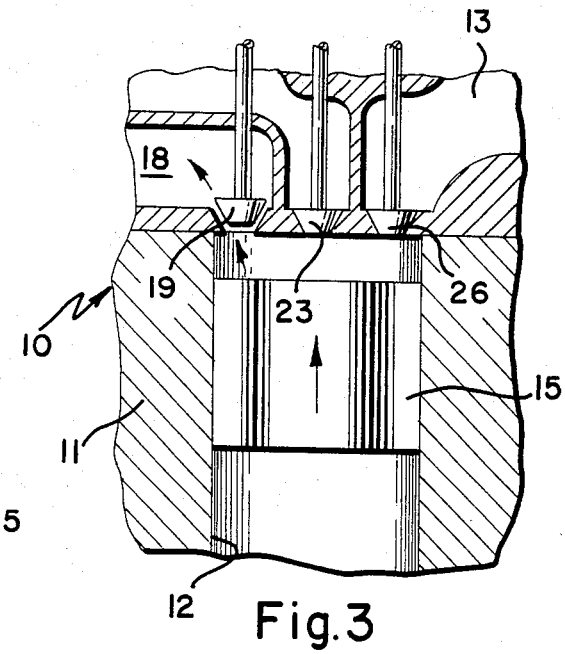

Referring next to FIG. 3, which shows the compression stroke. At that time, the valve 19 remains open while the valves 23 and 26 are closed by the operation of their cams. These cams are all linked together directly or indirectly to the crank shaft 17, so that they operate together during the rotation of the crank shaft. The fact that the valve 19 is open as the piston 15 moves upwardly means that the air compressed by the piston flows into the chamber 18 and the chamber 18 retains that compressed air. Since the piston 15 closely approaches the bottom surface 14 of the head 13, this chamber is necessary, of course, to receive the compressed air.

Figure 4:
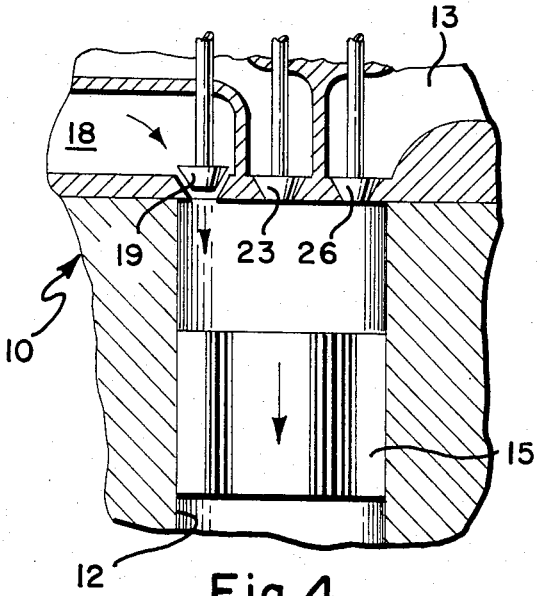

Turning next to FIG. 4, it can be seen that, during the firing portion of the cycle, the spark plug 22 fires and the piston is moved downwardly by the expansion of the hot gases which have been produced by the combustion. The firing takes place due to the compressed air moving from the chamber 18 around the valve 19 into the upper part of the chamber which has received the fuel from the fuel injection nozzle 21. The valve 19, of course, is open at this stage while the valves 23 and 26 remain closed.

Figure 5:
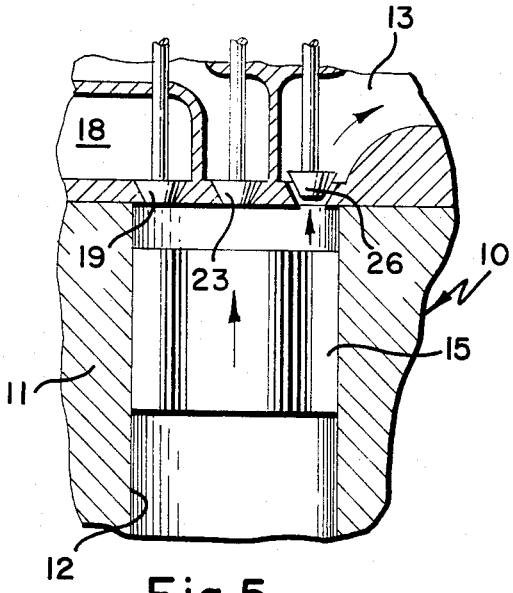

FIG. 5 shows the exhaust portion of the cycle, in which the piston 15 is moving upwardly and forcing the products of combustion outwardly. For this purpose, the valve 26 is open and connects the upper end of the bore above the piston 15 to the exhaust 28. Since the piston 15 approaches the lower surface 14 of the head 13 very closely, it can be seen the products of combustion are almost completely removed from the bore.

It can be seen, therefore, that the present invention allows a very clean type of combustion, since there are no products of combustion remaining in the bore at the time that the suction and compression cycles take place. This means that combustion takes place with pure air and no products of combustion or incombustible gases to inhibit the flame propagation or the ignition. Therefore, the combustion which takes place is under ideal conditions. Also, it can be seen that most of the changes from the conventional gasoline engine take place in the head 13 rather than the block 11 or associated equipment. In order to assure that the piston in the conventional engine approach closely to the lower surface 14 of the head, it is only necessary to remove a portion of the top of the conventional block. The provision of a plurality of valves and, particularly the chamber 18 can take place in the head itself, so that most of the conventional engine equipment can be used in modifying or designing an engine in accordance with the principles of the present invention.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Internal combustion engine of the 4-cycle type, comprising:

(a) a block having a cylinder bore, (b) a head mounted on the block and having a surface which closes one end of the bore, an inlet valve and an exhaust valve being mounted in the head, the inlet valve leading from the said surface of the head through a passage to a source of combustion air, and the exhaust valve leading from the surface of the head through a passage to exhaust, (c) a piston slidable in the bore to a position close to the head, so that very little product of combustion remains at the end of the exhaust stroke, (d) a chamber formed in the head and having access to the upper end of the bore, and (e) a third valve admitting compressed air into the chamber during the compression stroke and releasing the compressed air from the chamber into the bore during the power stroke, the third valve leading from the said surface of the head to the chamber, the said third valve being closed during the exhaust stroke and open during the compression stroke, wherein the valves when closed do not add to the volume of the bore, so that at the end of the exhaust stroke there is very little volume between the surface of the head and the piston.

* * * * *